United States Patent [19]

Heath, Jr.

[11] Patent Number: 4,457,437

[45] Date of Patent: Jul. 3, 1984

[54] TAMPER EVIDENT CHILD-RESISTANT CONTAINER CLOSURE

[76] Inventor: Harry G. Heath, Jr., Box 192, Milmay, N.J. 08340

[21] Appl. No.: 448,303

[22] Filed: Dec. 9, 1982

[51] Int. Cl.[3] ..... B65D 55/02

[52] U.S. Cl. ..... 215/224; 215/206; 215/252

[58] Field of Search ..... 215/223, 252, 224, 225, 215/206

[56] References Cited

U.S. PATENT DOCUMENTS

| | | | |
|---|---|---|---|
| 3,627,160 | 12/1971 | Horvath | 215/223 |
| 3,805,987 | 4/1974 | Horvath | 215/252 |
| 4,098,419 | 7/1978 | Virog, Jr. et al. | 215/252 |

*Primary Examiner*—George T. Hall

*Attorney, Agent, or Firm*—B. P. Fishburne, Jr.

[57] ABSTRACT

When a child-resistant cap for a container of potentially hazardous contents is turned in either direction of rotation to a release position, cooperative parts on the cap and container will engage and interact to produce a permanent visual indication of tampering.

11 Claims, 9 Drawing Figures

FIG.1
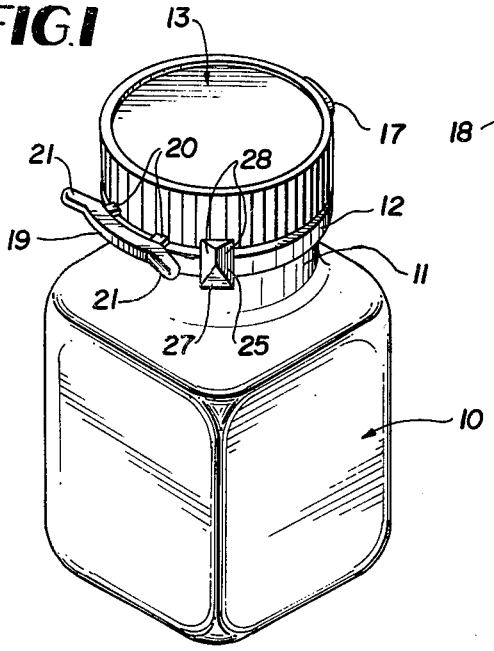
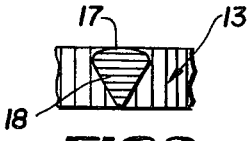
FIG2a
FIG.2
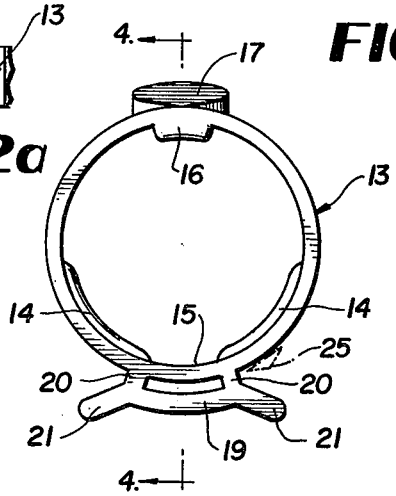
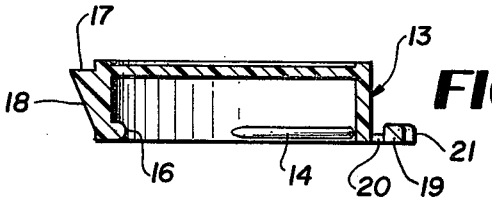
FIG.4
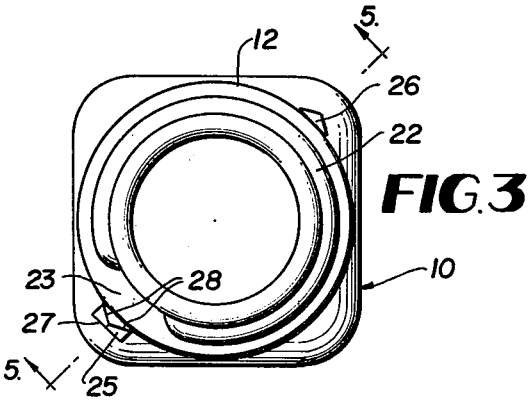
FIG.3
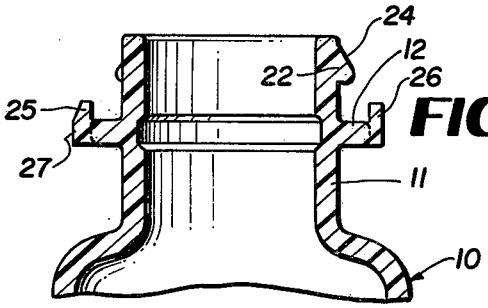
FIG.5
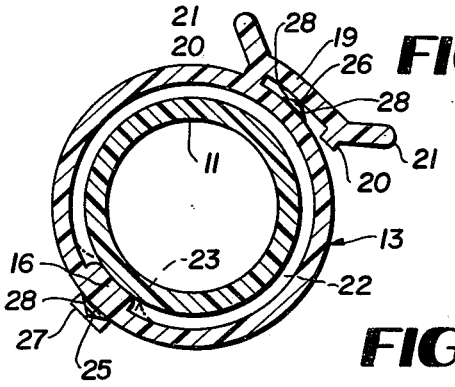
FIG.6
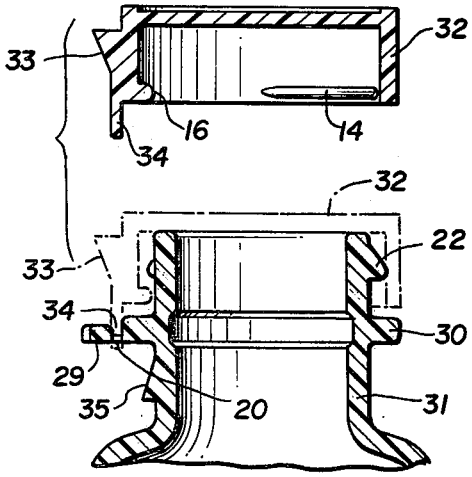
FIG.8
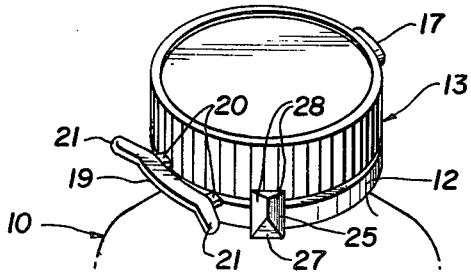
FIG.7

TAMPER EVIDENT CHILD-RESISTANT CONTAINER CLOSURE

BACKGROUND OF THE INVENTION

The objective of the present invention is to satisfy a current urgent need for a simple, practical and economically feasible means to protect the public from the sometimes disastrous results of tampering with non-prescription medicines and the like prior to their purchase by innocent customers.

More particularly, it is an object of the invention to avoid making the solution to the above problem so difficult and awkward that the benefits become largely lost, as a practical matter, because the public simply will not accept the inconveniences which arise from the solution of the problem.

Other specific objects and advantages of the invention will become apparent to those skilled in the art during the course of the following description.

BRIEF DESCRIPTION OF THE DRAWINGS

FIG. 1 is a perspective view of a container equipped with a tamper evident safety cap according to one preferred embodiment of the invention.

FIG. 2 is a bottom plan view of the cap in FIG. 1.

FIG. 2*a* is a fragmentary side elevation of the cap showing a lifting and indicating projection.

FIG. 3 is a plan view of the container in FIG. 1 with the cap removed.

FIG. 4 is a vertical section through the cap taken on line 4—4 of FIG. 2.

FIG. 5 is a vertical section through the container neck taken on line 5—5 of FIG. 3.

FIG. 6 is a horizontal section taken through the assembled container and cap evidencing tampering.

FIG. 7 is a perspective view of the container and cap evidencing tampering.

FIG. 8 is an exploded vertical sectional view of the container and cap according to a modification of the invention.

DETAILED DESCRIPTION

Referring to the drawings in detail wherein like numerals designate like parts, the numeral 10 designates a container for medicines and the like, such as a molded plastics container, having a neck 11 carrying the customary annular dust ring 12 formed integrally therewith, the mouth of the neck 11 being disposed well above the dust ring, FIG. 5.

A coacting removable closure cap 13, also molded from suitable plastics, is constructed generally according to the teachings of prior U.S. Pat. No. 3,627,160 to Horvath. As disclosed in such patent, the cap 13 on the interior of its annular side wall is provided with a pair of opposing arcuate ribs 14 separated by a gap 15. Each rib 14 spans roughly one-quarter of the cap's circumference on opposite sides of the gap 15 which is relatively narrow. Diametrically opposite from the gap 15 on the interior of the cap side wall is a cap locking tab 16 of similar width to the gap 15.

At the same circumferential location on the cap side wall, but on its exterior, a cap lifting projection 17 is provided by molding. This projection includes an inclined thumb-engaging surface 18 which diverges upwardly from the central axis of the container.

In accordance with U.S. Pat. No. 4,098,419 to Virog, Jr. et al., a tamper indicating element in the form of a short arcuate bar 19 is disposed on the exterior of the cap side wall close to its bottom edge, and is spaced somewhat radially from the side wall by a pair of thin frangible radial connecting tabs 20 joined integrally to the side wall and the tamper indicator element 19. At opposite ends of the bar or element 19, a pair of comparatively short arms 21 of equal lengths are provided, and these arms are arranged divergently relative to each other and relative to the peripheral face of the cap side wall, FIG. 2, so as to form two tapering recesses or pockets between the arms 21 and cylindrical cap side wall.

The previously-mentioned internal ribs 14 and locking tab 16, FIG. 4, are also located substantially at the lower edge of the cap 13 at the elevation of the indicator bar 19.

Further in accordance with the Horvath patent, the neck 11 of container 10 is further provided above the dust ring 12 and near the mouth of the neck with an exterior annular bead 22 which is interrupted at one point by a gap 23 of sufficient width to enable the passage therethrough of cap locking tab 16, when the latter is circumferentially aligned with the gap 23, FIG. 6. The top face 24 of bead 22 is preferably steeply inclined as shown in FIG. 5, also in accordance with the Horvath patent.

A pair of indicator element severing lugs 25 and 26 are formed integrally on dust ring 12 and extend vertically from the bottom face of the dust ring 12, FIG. 5, to elevations sufficiently above the dust ring to be in the paths of rotational travel of the arms 21 of the indicator element or bar 19. The lug 25 has a vertical lower face 27 in the form of an arrow pointing upwardly, FIG. 1, in lieu of similar indicia on the neck of the container in the Horvath patent. This relatively stationary upwardly pointing indicia face 27 of the container is adapted for alignment with the inclined face of lifting projection 17, which face is preferably designed as a downwardly pointing arrow, FIG. 2*a*.

As shown in FIGS. 1 and 6, the side walls 28 of lugs 25 and 26 converge to form side vertical relatively sharp edges on the two lugs at least in their regions which project above the dust ring 12. These opposite side vertical cutting edges of the two lugs 25 and 26 are adapted to sever the frangible connecting tabs 20 during relative rotation of the container and cap in either direction, as will be further described. When either lug 25 or 26 enters the space between one of the arms 21 and the periphery of cap 13, one of its convergent faces 28 above the level of dust ring 12 will cammingly engage the inner side of arm 21 forcing the same outwardly, and immediately thereafter one relatively sharp edge of the lug will engage and sever the thin frangible connecting tab 20 in its path. Since the tab is already being stretched by the described camming action, it is more readily severed by the sharp edge of the lug 25 or 26. FIGS. 6 and 7 show the severed condition of one connecting tab 20 which causes the entire tamper indicator bar 19 to leave its normal position shown in FIGS. 1 and 2 and project outwardly at an angle relative to the cap 13.

The overall mode of operation of the container closure is as follows. With the cap safely locked on the container neck in accordance with the teachings of the Horvath patent, the ribs 14 and locking tab 16 of the cap are below the interrupted bead 22 and the cap may rotate freely on the container in either direction. Both frangible connector tabs 20 are intact. In order to release the safety cap from the container, the cap 13 must be turned until the arrow 18 of the cap is in alignment with the oppositely facing arrow 27 of lug 25. To achieve this alignment, the cap can be rotated in either direction until the locking tab 16 of the cap registers with the gap 23 of bead 22, FIG. 6. In this latter position, the safety cap 13 can be removed.

However, in arriving at the removal position, the cap during rotation in either direction will have one of its two connecting tabs 20 engaged by one of the beveled lugs 25 or 26 on the container immediately above the dust ring 12, and this engagement cleanly sever the particular connecting tab 20 in the manner already described. Thus, it is impossible to remove the safety cap from the container by rotation in any direction to the release position without first destroying one of the connecting tabs 20 of the tamper indicating element 19. Therefore, when a particular container has been tampered with and opened prior to sale, a customer can tell at a glance that tampering has occurred by looking at the element 19 and observing its severed tab 20. The full and normal utility of the cap 13 as a child-resistant safety cap is not interfered with in the slightest and the mode of operation required to remove the cap from the container in accordance with the Horvath patent remains basically unchanged in the present invention. Once alignment of the two arrows 18 and 27 is achieved by mutual rotation of the cap and container, upward thumb pressure against the surface 18 of projection 17 will effect removal of the cap, the locking tab 16 passing through the gap 23. The device is very simple, convenient to use, and effective. A tamper evident child-resistant cap is achieved without the necessity for applying expensive seals to the closure which require cutting before opening or employing shrink packaging techniques or other costly inconvenient procedures.

FIG. 8 shows an embodiment of the invention in which the tamper indicator element 29 is applied to the dust ring 30 of container neck 31 and the rotational child-resistant cap 32 adjacent to its lifting projection 33 is provided with a single depending severing lug 34 for the aforementioned connecting tabs 20 of the tamper indicating element, one such tab being shown in FIG. 8 in the path of movement of the lug 34. The alignment arrow on the container neck 31 which coacts with the opposing arrow on projection 33 is shown at 35 in FIG. 8. In all other respects, the construction and mode of opeation of the device may be substantially identical to the arrangement in FIGS. 1 through 7. In turning the cap 32, FIG. 8, in either direction to the cap release position, the single lug 34 will inevitably have to pass through and sever one of the connecting tabs 20 before reaching the release position.

The advantages of both disclosed embodiments of the invention should now be readily apparent to those skilled in the art.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A tamper evident child-resistant container closure comprising a container body and a closure cap for the container body, the container body and closure cap having cooperative snap-engageable parts which lock the closure cap onto the container body and permit rotation of the closure cap in either direction of rotation freely while locked to a closure cap release position, and cooperative tamper indicating means on the container body and closure cap including circumferentially spaced frangible parts at least one of which is destroyed during rotation of the closure cap relative to the container body toward said release position in either direction of rotation.

2. A tamper evident child-resistant closure as defined in claim 1, wherein said cooperative tamper indicating means comprising an indicating element on the periphery of the closure cap and turning with the cap and having two circumferentially spaced frangible tabs connecting the element to the cap, and a pair of diametrically oppositely spaced lugs on the container body in the paths of movement of said frangible connecting tabs, whereby at least one connecting tab must be served by one of said lugs during rotation of the cap in either direction toward the release position.

3. A tamper evident child-resistant closure for a container comprising a cap rotationally engaged and locked on the container and being turnable relative to the container in opposite directions of rotation to a release position, cooperative tamper indicating means on the container and cap including circumferentially spaced frangible parts at least one of which is destroyed during relative rotation of the cap and container toward said release position, said cooperative tamper indicating means comprising an indicating element on the periphery of the cap and turning with the cap and having two circumferentially spaced frangible tabs connecting the element to the cap, a pair of diametrically opposed spaced lugs on the container in the paths of movement of said frangible connecting tabs, whereby at least one connecting tab must be severed by one of said lugs during rotation of the cap in either direction toward said release position, and a lifting projection on the periphery of the cap diametrically opposite from the indicating element and adapted to cooperate with one of said lugs to indicate to a user that the cap is in the release position.

4. A tamper evident child-resistant closure as defined in claim 3, and said indicating element comprising a bar spaced from the periphery of the cap and said frangible tabs being substantially radially disposed and connecting the bar near its ends to the periphery of the cap.

5. A tamper evident child-resistant closure as defined in claim 4, and the bar having end extensions which project circumferentially beyond the frangible tabs and are divergent from adjacent portions of the cap periphery.

6. A tamper evident child-resistant closure as defined in claim 5, and the bar and frangible tabs being disposed adjacent to the lower edge of the cap and said lugs extending above the lower edge of the cap and having cutting edges in the paths of movements of the tabs with said cap.

7. A tamper evident child-resistant container closure as defined in claim 12, wherein said cooperative tamper indicating means comprises said circumferentially spaced frangible parts being attached to the container body in the path of rotational movement of a severing lug on the closure cap dependingly and turning with the closure cap, whereby the severing lug must sever one of said frangible parts during rotation of the closure cap in either direction to said release position.

8. A tamper evident child-resistant container closure as defined in claim 7, and a pair of alignable indicators on the cap and container body to facilitate rotating the cap in either direction to the release position.

9. A tamper evident child-resistant container closure comprising a container body and a closure cap for the container body, the container body and closure cap having cooperative snap-engageable parts which lock the closure cap onto the container body and permit rotation of the closure cap in either direction on the container body while locked thereon to a release position, and rotationally cooperative frangible tamper indicating means on the container body and closure cap constructed and arranged so that relative rotation of the container body and closure cap in either direction toward the release position will at least partly destroy said frangible tamper indicating means in a manner permanently altering the appearance of such means.

10. A tamper evident child-resistant closure as defined in claim 9, and the frangible-tamper-indicating means comprising an indicating bar on the cap near and outwardly of its periphery and connected to the cap periphery by a circumferentially spaced pair of frangible tabs, and a pair of diametrically opposed lugs on the container body extending into the paths of movement of said tabs whereby rotation of the cap to a release position in either direction will result in the destruction of one tab by one of said lugs, and a position indicator on said cap diametrically opposite from said indicating bar and being alignable with a position indicator on one of said lugs at the release position of the cap.

11. A tamper evident child-resistant closure as defined in claim 10, wherein the container body includes a neck having a dust ring spaced from the mouth of the neck, said indicating bar being disposed near and above the dust ring when the cap is rotationally and lockably engaged with the container, and the diametrically opposed lugs being fixed to the dust ring and extending above the top surface thereof.

* * * * *